United States Patent [19]

Stricker et al.

[11] 4,086,867

[45] May 2, 1978

[54] BOUNDARY LAYER INLETS AND TRANSVERSE MOUNTED PUMPS FOR WATER JET PROPULSION SYSTEMS

[75] Inventors: John G. Stricker, Annapolis; John G. Purnell, Catonsville, both of Md.

[73] Assignee: The United States of America as represented by the Secretary of the Navy, Washington, D.C.

[21] Appl. No.: 775,218

[22] Filed: Mar. 7, 1977

[51] Int. Cl.[2] ..... B63H 11/04

[52] U.S. Cl. ..... 115/14; 60/222

[58] Field of Search ..... 114/151; 115/11, 12 R, 115/14, 15, 16; 60/221, 222; 74/665 S

[56] References Cited

U.S. PATENT DOCUMENTS

| | | | |
|---|---|---|---|
| 2,282,612 | 5/1942 | Schultz | 115/900 |
| 2,775,204 | 12/1956 | Batten | 74/665.5 |
| 3,076,426 | 2/1963 | Alexander | 115/14 |
| 3,112,728 | 12/1963 | Krause | 115/37 |
| 3,155,071 | 11/1964 | Buttner | 60/222 |
| 3,326,163 | 6/1967 | Davis | 115/16 |
| 3,811,398 | 5/1974 | Burgin | 115/11 |
| 3,826,217 | 7/1974 | Canova | 115/12 R |
| 3,865,067 | 2/1975 | Archer | 115/12 R |

*Primary Examiner*—Trygve M. Blix
*Assistant Examiner*—D. W. Keen
*Attorney, Agent, or Firm*—R. S. Sciascia; Q. E. Hodges

[57] ABSTRACT

A water jet propulsion system of improved efficiency with a novel boundary layer water inlet, and having multiple water jet pumps and motors. The inlet has a large width to height ratio. The pumps may be connected to one drive shaft which can be connected to one or more motors by means of clutches.

11 Claims, 6 Drawing Figures

10
10
10

BOUNDARY LAYER INLETS AND TRANSVERSE MOUNTED PUMPS FOR WATER JET PROPULSION SYSTEMS

The invention described herein may be manufactured and used by or for the Government of the United States of America for governmental purposes without the payment of any royalties thereon or therefor.

BACKGROUND OF THE INVENTION

This invention relates to water jet propulsion systems for marine vehicles and in particular to means for making these propulsion systems more efficient. Water jet propulsion systems for marine vehicles usually comprise one or more pumps which pump water in through one or more inlets mounted on the bottom of the vehicle and discharge it out through nozzles which are pointed in a direction which is opposite from the direction of travel of the vehicle. The amount of thrust which is generated by such a system is directly proportional to the rate at which the system adds momentum to the water that is pumped in through the inlet and out the nozzle. The amount of momentum which the propulsion system will add to this water during any fixed period of time will be directly proportional to the volume of water which is pumped through the system, and to the difference between the momentum velocity of water entering the inlet and the velocity of the water leaving the nozzles. The momentum velocity of the water entering the inlet represents the velocity of the inlet entering water relative to the hull in the region from which the water is obtained. This relationship is shown by the equation $$T = \sigma Q(V_j - V_m)$$

where $T$ equals the thrust, $\sigma$ equals the density of water, $Q$ equals the flow rate of water in volume per unit time, $V_j$ is the jet velocity of the water leaving the nozzle, and $V_m$ is the momentum velocity of the water entering the inlet.

The amount of thrust that is produced by any actual water jet propulsion system will always be less than the value obtained from the above equation because this equation does not account for the various kinds of losses which will occur in any actual propulsion system. If the water velocity through the system is too high, low pressure points may be created at various places in the system which will cause the water to cavitate. This cavitation will result in large numbers of bubbles which will seriously restrict the flow rate of water through the propulsion system and thus lower the thrust. The bubbles cause by cavitation may also cause erosion and eventually damage to various parts of the system. Kinetic energy is also wasted because of friction between the high velocity water flow through the ducts, pumps and nozzles of the system. The losses in thrust for this reason can be reduced by minimizing the velocity of the water through the system and by minimizing the length of the nozzles and water ducts. The nozzles at the outputs of the pumps are made very short because the jet velocity of the water passing through the nozzles is much higher than the velocity of the water in any other part of the propulsion system.

As can be seen from the above equation, if the water jet velocity $V_j$ is reduced and the thrust produced by the propulsion is to remain constant, then either the flow rate Q must be increased or the water inlet velocity $V_m$ must be decreased. The trend of development in prior propulsion systems has been to increase efficiency by decreasing the water jet velocity $V_j$ and to compensate by increasing the flow rate Q so as to maintain the same amount of thrust. The velocity of water through any part of the propulsion system will always be inversely proportional to the cross sectional area of that part of the system and directly proportional to the flow rate through that part of the system. Therefore, when the prior art systems were made more efficient by decreasing the water jet velocity $V_j$ and increasing the flow rate Q, it was necessary to compensate by increasing the size of the water pumps and the nozzles. It was also necessary to increase the size of the water inlets if an increase in the water inlet and ducting velocities were to be avoided. Thus each successive increase in system efficiency resulting from lowering the water jet velocity and increasing the flow rate forces the propulsion system to become larger and heavier.

One way to increase the efficiency of the propulsion system without at the same time decreasing the thrust would be to decrease the water inlet velocity $V_m$. However, the minimum value of water inlet velocity that can be obtained is determined by the speed at which the marine vehicle is moving. The relative velocity of the water in the boundary layer very close to the hull of the marine vehicle, will always be much less than the velocity of the vehicle itself. The boundary layer water further away from the hull of the marine vehicle will be moving at a faster velocity with respect to the vehicle, and the relative velocity between the marine vehicle and any water beyond the boundary layer will be the same as the velocity of the marine vehicle through the main body of water. Thus, while the vehicle is moving, the water will always be forced into the inlet at some minimum velocity which is determined by the speed of the marine vehicle, the characteristics of the boundary layer surrounding the vehicle hull, and the shape of the water inlets. The prior art water inlets have been constructed so that the width dimension, measured along a line perpendicular to the length of the hull, has been from one to two but never higher than five times the height dimension of the inlets. In order to take enough water through these prior art inlets to satisfy the flow rate requirements of the propulsion systems, it has been necessary for the inlets to take in not only water from the boundary layer close to the vehicle hull but also water from outside the boundary layer which is moving at high velocities with respect to the hull. The resulting water inlet velocities of these prior art systems would therefore approach the value of the relative velocity between the vehicle and the main body of water.

Most of the prior art water jet propulsion system units comprise only one pump which is driven by only one motor. Operation of such a propulsion system at part power can be accomplished only by operating the motor at part power. Those prior art propulsion systems which have multiple pumps with each pump being connected to a separate motor can be operated at part power by shutting down one or more complete motors and pumps while operating one or more of the other motors and pumps at full up to power. When either of these methods of part power operation is used, the propulsion system will be operating much less efficiently than it is when operating at full power. Many kinds of power sources, such as gas turbines, will operate efficiently only when they are delivering close to their full power output. When these types of power sources are used in propulsion systems and operated at part power, the overall efficiency of the propulsion systems is greatly decreased. The kinetic energy loss which results when the high velocity water is emitted from the nozzles is porportional to the square of the water jet velocity. Therefore, in any propulsion system with two or more pumps, this loss will be minimized, for any fixed overall thrust, when the pumps are operated so that the water velocities through each of the nozzles are equal and therefore minimum. Thus when a water jet propulsion system with multiple pumps is operated at part power, this loss will be minimized when all of the pumps are operated at the same time instead of having one or more pumps turned off completely while the others are operating at high speed and therefore with higher jet velocities.

SUMMARY OF THE INVENTION

This invention uses a special water inlet which results in a lower water inlet momentum velocity when used in a water jet propulsion system. The use of this inlet will not reduce the thrust of a propulsion system because this inlet does not affect the water jet velocity or the flow rate produced by the system. The height of this special inlet is small enough so that only that water in the boundary layer close to the vehicle hull and moving at approximately the same speed as the vehicle will enter the inlet. The water inlet is made very wide so that enough water will enter through it to satisfy the flow rate requirements of the propulsion system despite the small inlet height. The maximum height of the water inlet will normally be less than the thickness of the boundary layer of water which are moving slowly with respect to the vehicle hull. The maximum width of the inlet will be determined by the beam width of the vehicle hull. The resulting water inlet momentum velocities that can be obtained with this boundary layer inlet are lower than could be obtained with prior art inlets operating under the same conditions and with the same flow rate. By lowering the water inlet momentum velocity in this way, the propulsion system can be made smaller and lighter by decreasing the flow rate, or the system can be made more efficient by reducing the water jet velocity. By lowering the inlet momentum velocity, both of these improvements in propulsion systems performance can be made without at the same time decreasing the thrust.

The invention also provides for the use of several water pumps mounted side by side behind the boundary layer water inlet. The positions of the water intakes of these pumps and the spacings between them are adjusted in such a way as to minimize the amount of water flow in any direction which is parallel to the width dimension of the water inlet. The resulting water flow through the intake manifold between the water inlet and the pump intake will be close to two dimensional. These two dimensions will be along any plane surface which is parallel to both the height dimension of the water inlet and the length dimension of the marine vehicle. This two dimensional flow pattern through the water intake manifold will cause less turbulence and fewer energy losses than would occur if the water flow pattern were three dimensional.

The invention also allows for the water jet propulsion system to operate efficiently at less than full power by connecting all of the pumps to the same drive shaft. At least two motors may be used to power this drive shaft and each of these motors may be connected or disconnected from the drive shaft by means of clutches. The propulsion system can then be operated at partial power by disconnecting one or more motors from the drive shaft and operating the remaining motors at up to their full rated power level, where they operate most efficiently. This configuration also allows all of the pumps to be driven at the same time regardless of whether the propulsion system is operating at full power or partial power, which results in high operating efficiency since maximum nozzle areas is maintained in use.

OBJECTS OF THE INVENTION

It is therefore an object of this invention to provide increased overall propulsive efficiency over the entire operating range for water jet propulsion systems.

It is a further object of this invention to minimuze the momentum velocity of water entering the inlets of water jet propulsion systems.

It is yet another object of this invention to minimize the kinetic energy losses resulting from the flow of water through the inlets, intake manifolds, pumps and nozzles of water jet propulsion systems.

It is still a further object of this invention to control the water flow patterns through the intake manifolds of a water jet propulsion system in such a way that the kinetic energy losses of the water are minimized.

It is another object of this invention to allow the power sources driving a water jet propulsion system to operate at their most efficient level of operation regardless of whether the propulsion system as a whole is operating at full power or partial power.

Another object of this invention is to minimize the size and weight of a water jet propulsion system without at the same time decreasing the efficiency at which the system operates.

Other objects, advantages and novel features of this invention will become apparent from the following detailed description of the invention when considered along with the accompanying drawings.

BRIEF DESCRIPTION OF THE DRAWINGS

Where two or more figures of the drawings show the same structural element, the element has been labeled with the same number.

DESCRIPTION OF THE PREFERRED EMBODIMENTS

Figure 1:
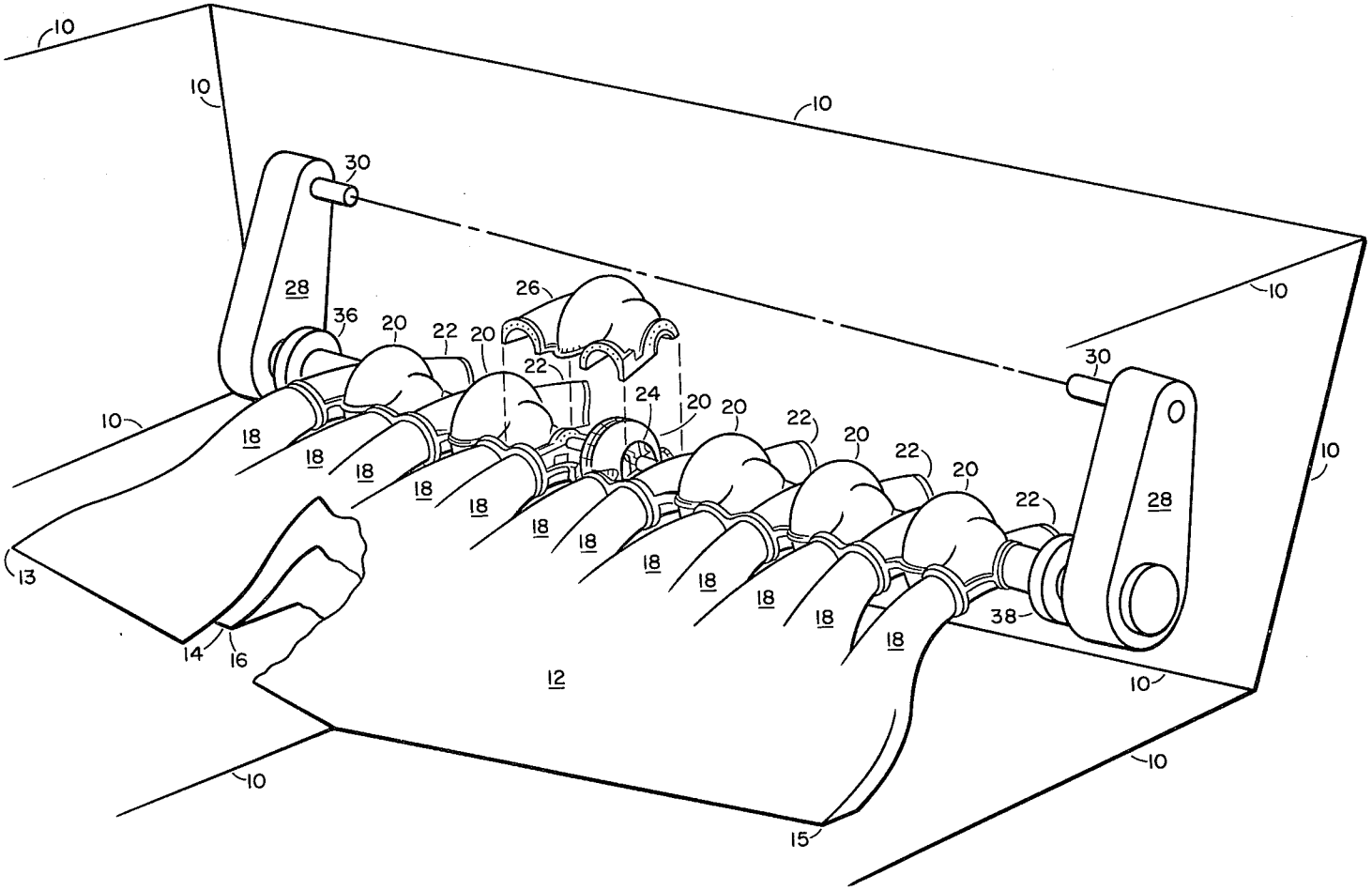
FIG. 1 is a pictorial view of the preferred embodiment of the water jet propulsion system.

FIG. 1 shows a pictorial view of the preferred embodiment of the invention. This figure shows a water jet propulsion system mounted on a small marine vehicle which may be either a displacement or a planing craft type vehicle. The outlines of the vehicle hull 10 show how the water jet propulsion system would be located and oriented in the stern of the vehicle. Water enters the propulsion system through the throat 14 of the water inlet. The lower edge of the inlet or inlet lip 16 can be positioned in the vehicle hull so that the inlet is either flush or semi flush. In a flush inlet no part of a inlet protrudes beyond the surrounding surface of the hull. In a semi flush inlet, the inlet lip will protrude somewhat beyond the surrounding surface of the hull. The width of the inlet extends from point 13 to point 15 and is at least ten times larger than the height of the inlet. Water entering through the inlet throat 14 flows through the pump intake manifold 12, to the several water pump intakes 18. The cross sectional area of the intake manifold 12, as measured on a cross section approximately perpendicular to the direction of water flow, is small enough so that it is not substantially larger than the combined cross sectional area of all the pump intakes 18. Six double width double inlet centrifugal flow pumps 20 pump the water from their water intakes 18 out through the nozzles 22. FIG. 1 shows the upper piece of the outer shell 26 and the impeller 24. All of the pumps may be mounted on a common shaft which may be connected by way of clutches 36 and 38 to reduction gears 28 at either end of the shaft. A power source, such as a gas turbine, (not shown) is connected to each of the two shafts 30 which drive the reduction gears 28 and drive the pumps 20. When either of the two clutches 36 or 38 is disengaged, all of the six pumps will be driven at part power by one of the two power sources. When both of the clutches are engaged, the six pumps will be driven at full power by both of the power sources.

Figure 2:
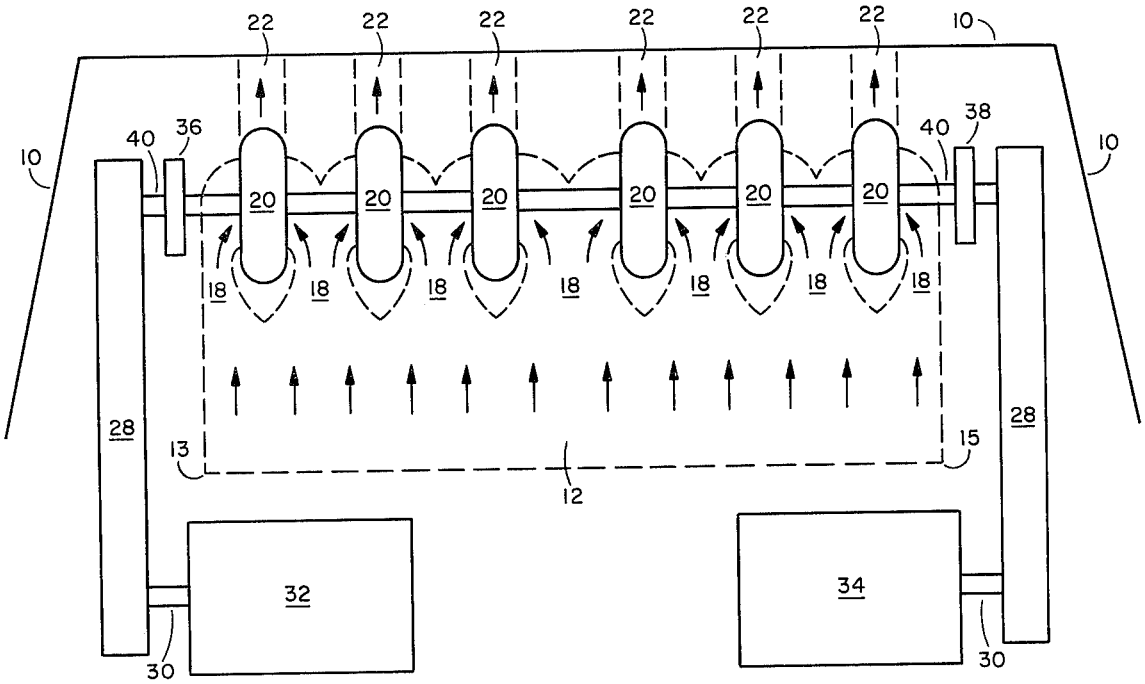
FIG. 2 shows a plan view of the preferred embodiment shown in FIG. 1 as the system would be viewed along a horizontal plane.
Figure 2A:
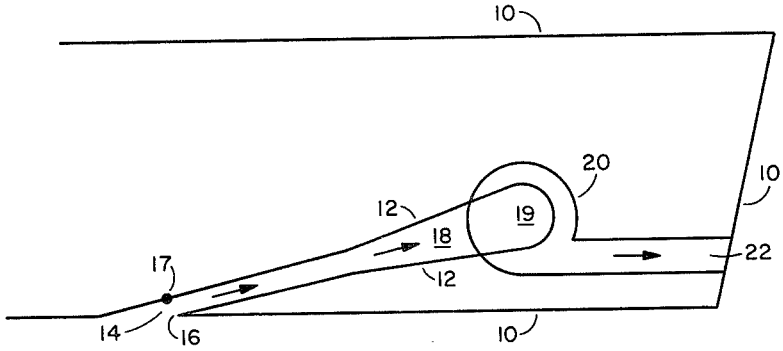
FIG. 2A shows a cross sectional view of the preferred embodiment shown in FIG. 1 with the cross section taken through a vertical plane perpendicular to the plane of FIG. 2 along the line AA.

FIGS. 2 and 2A show a plan view and a cross sectional view of the preferred embodiment that was shown in FIG. 1. The plan view shown in FIG. 2 is along a horizontal plane. The cross section shown in FIG. 2A is along a vertical plane which is oriented along the line AA, shown in FIG. 2. In FIG. 2, the two power sources 32 and 34 are connected by means of shafts 30 to the reduction gears 28 which turn the main drive shaft 40. Either of the two power sources 32 and 34 can be disconnected from the main drive shaft 40 by disengaging one of the two clutches 36 and 38. The six double width double inlet centrifugal flow pumps 20 are all driven by the main drive shaft 40. Water flows through the intake manifold 12, through the pump intakes 18, and out the pump nozzles 22 along the directions shown in FIG. 2 by the arrows. The outline of the hull 10 of the marine vehicle shows how the propulsion system fits into the stern of the vehicle. The line of six pumps 20 mounted on the main drive shaft 40 extend substantially the full distance from one side of the vehicle to the other. The width of the water inlet extends from point 13 to point 15 in FIG. 2, which is also most of the way across the bottom of the vehicle. The height of the water inlet extends between points 16 and 17 in FIG. 2A and is less than one tenth of the size of the inlet width. Water entering the throat of the inlet flows through the intake manifold 12 in the direction shown by the arrows in FIG. 2A. The water flows through a diffuser section 18 of the intake manifold 12 and enters the intake 19 of the pump 20. The water leaves the pump 20 through the pump output and flows through the nozzle 22.

Figure 3:
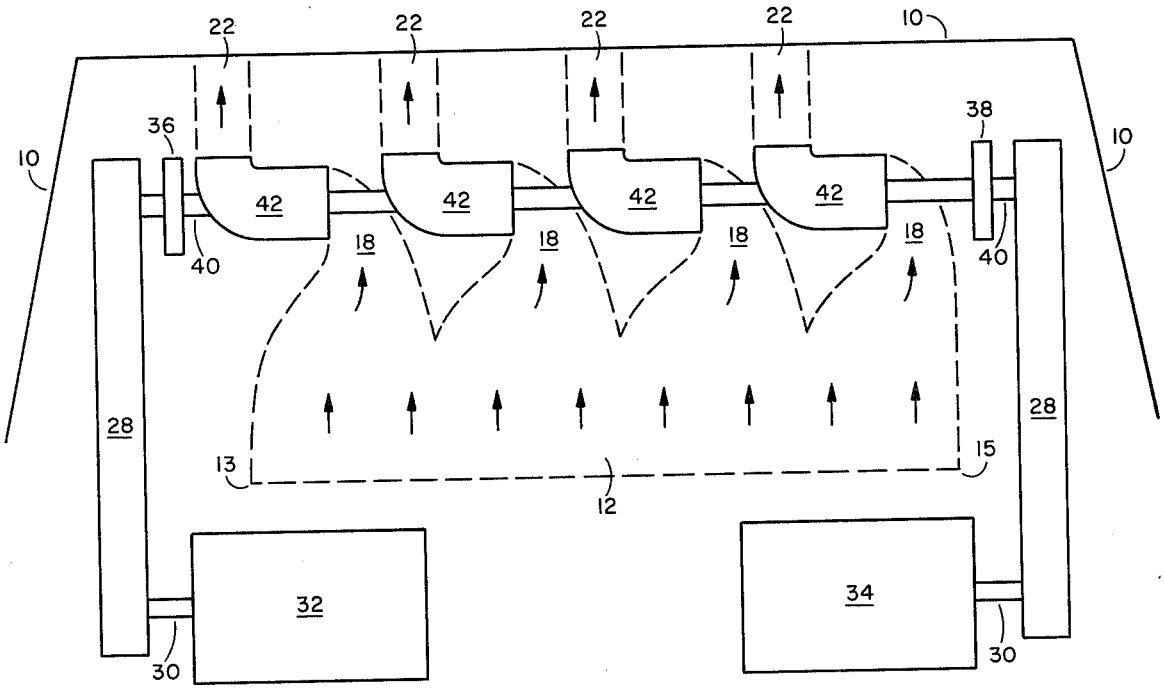
FIG. 3 shows another embodiment of the invention which is like the embodiment of FIGS. 1 and 2 except that axial flow pumps are used instead of centrifugal flow pumps.
Figure 4:
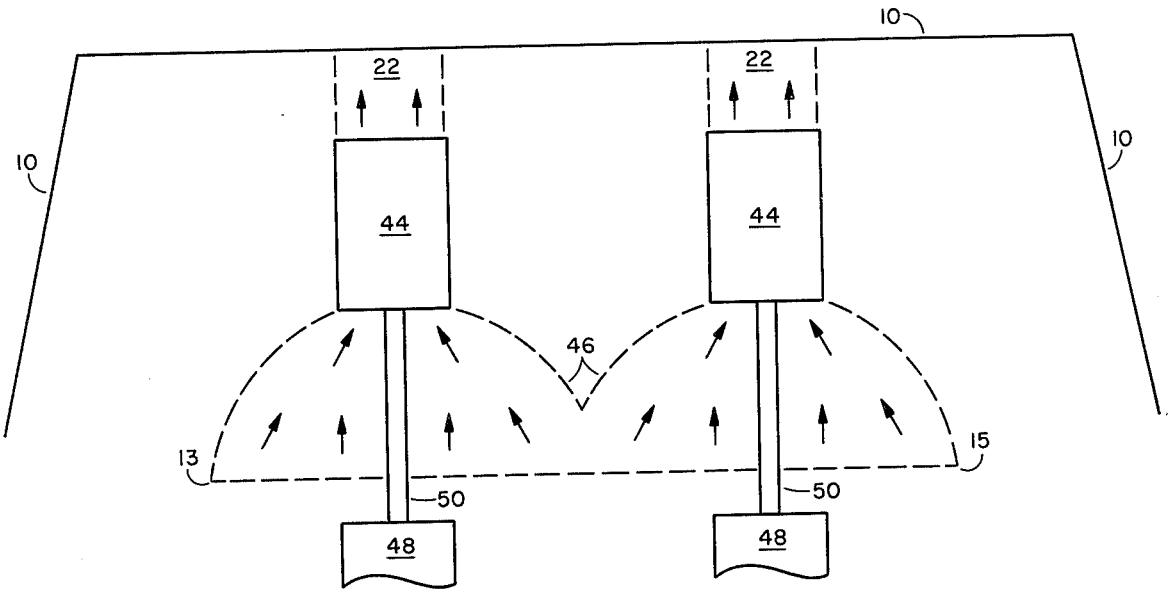
FIG. 4 shows yet another embodiment of the invention in which the two pumps used are not connected to the same drive shaft.
Figure 5:
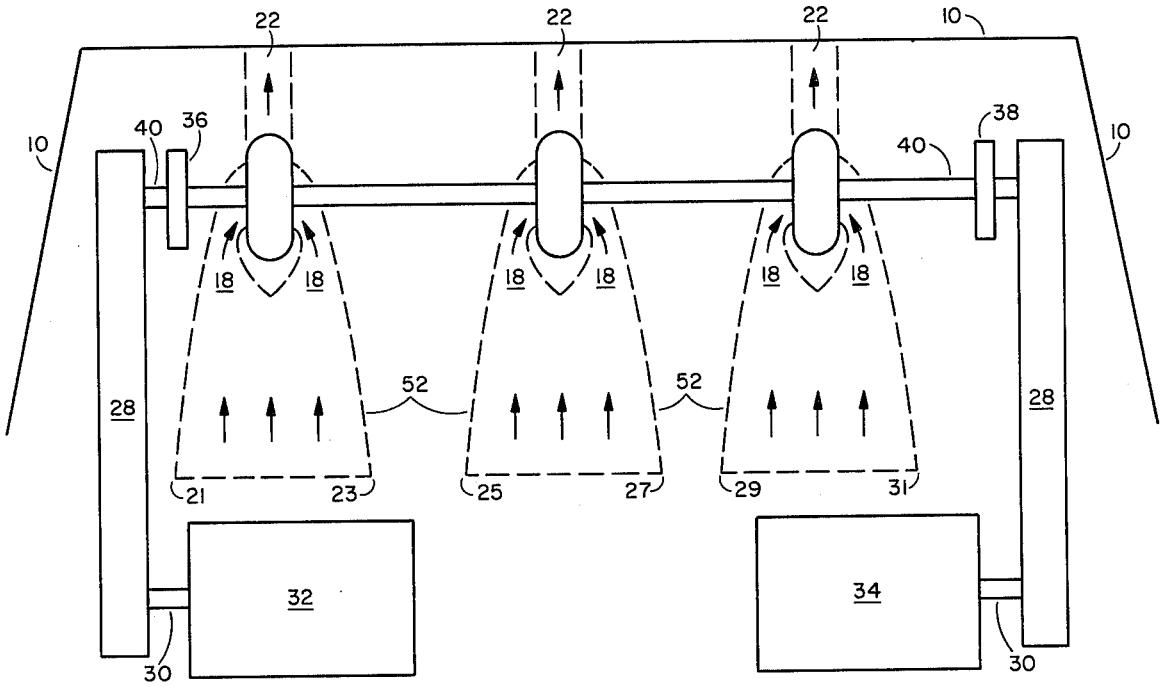
FIG. 5 shows another embodiment of the invention similar to the embodiments shown in FIGS. 1, 2, and 3 except that the boundary layer inlet is separated into three separate inlets having the same heights.

There are many alternative embodiments of the invention and three of these alternative embodiments are shown in FIGS. 3, 4, and 5. FIG. 5 illustrates the use of three separate boundary layer water inlets to supply water separately to each of the three propulsion pumps. A vertical cross sectional view of the propulsion system shown in FIG. 5 would be the same as is shown in FIG. 2A. The height of each of the three water inlets shown in FIG. 5 would be approximately the same as the height of the one water inlet of the propulsion system shown in FIGS. 2 and 2A. The sum of the widths of the three inlets in the propulsion system of FIG. 5, as measured between the points 21 and 23, 25 and 27, and 29 and 31, would be approximately the same as the width of the one water inlet of the FIG. 2 propulsion system. The water inlets of the propulsion system shown in FIG. 5 would draw most or all of their water from the slower moving boundary layers close to the vehicle hull in the same way as does the single water inlet of the propulsion system shown in FIG. 2. The one water inlet shown in the embodiment of FIG. 2 could potentially be broken up into any number of separate water inlets with each inlet providing water to any number of propulsion pumps. Such a system of inlets will be equivalent to one boundary layer inlet as long as the height of each of the inlets is small enough so that only the slower moving water in the boundary layers close to the vehicle hull enters the inlets and the sum of the widths of all of the water inlets in the propulsion system is at least ten times greater than the average inlet height. If the sum of the widths of all the inlets were less then ten times the average height of the inlets, then the cross sectional area of all the water inlets would probably be too small to allow an adequate flow rate of water through the propulsion system. An adequate flow rate of water through the propulsion system is necessary for the system to meet the thrust requirements of the marine vehicle it is mounted on.

FIG. 3 shows an embodiment of the invention like that shown in FIG. 2 except that four axial flow pumps 42 are used instead of the six centrifugal flow pumps 20. It would also be possible to use single inlet centrifugal pumps instead of the double inlet centrifugal pumps shown in FIG. 2. Any type of pump which is practical for use in water jet systems can be used with the boundary layer water inlets of this invention. Any number of pumps can be used in the propulsion system down to as few as one. However, the use of only one or two pumps as shown in FIG. 4 will result in higher flow energy losses because of the three dimensional water flow pattern through the water intake manifold. The use of a large number of pumps in a water jet propulsion system that has a wide water intake, as illustrated in FIGS. 1, 2 and 3, will result in a nearly two dimensional water flow pattern through the intake manifold. The water flow distribution losses in the intake manifold can be minimized when, as shown in FIGS. 2 and 3, several pumps are used and the pumps intakes are evenly spaced across the width of the intake manifold. The water jet propulsion system shown in FIG. 4 illustrates how a boundary layer water inlet can be used in combination with two or more independent pumps 44 which are driven by separate power sources 48 by means of separate drive shafts 50. It is not necessary for all of the pumps used in combination with a boundary layer inlet to be driven by the same drive shaft. Each pump may be driven independently by a separate power source as shown in FIG. 4 without having the propulsion system lose the benefit of the lower water inlet momentum velocity that results from the use of a boundary layer inlet. The inlet flow distribution losses through the intake manifold can be minimized by increasing the number of independent pumps and power sources.

There are three aspects of this invention which operate independently to make water jet propulsion systems more efficient. The use of a boundary layer water inlet will make the propulsion system more efficient by achieving lower water inlet momentum velocities regardless of the water flow pattern.

In any water jet propulsion system that uses a wide water inlet, even if the height of the inlet is so great that a substantial amount of water from outside the boundary layers flows through it, the flow distribution losses through the water intake manifold will be minimized if several pumps are used and they are evenly spaced across the width of the manifold. In any water jet propulsion system that uses two or more pumps, the system can be made to operate more efficiently at part power if the pumps are connected to one drive shaft, which in turn is driven by two or more power sources which can be engaged or disengaged from the drive shaft. The greatest possible efficiency in a water jet propulsion system can be obtained by combining all three of these independent features of the invention.

There are several factors which must be taken into consideration when designing the size and shape of a boundary lever water inlet for a water jet propulsion system. The aspect ratio of a water inlet is defined as the width of the inlet divided by its height. The aspect ratio of a boundary layer inlet may be as high as 70. The prior art water inlets usually have aspect ratios of about 1 or 2, but never higher than 5.

Because a high aspect ratio is an important requirement of the boundary layer inlets of this invention, it is necessary to be very precise when defining what the aspect ratio is. In the embodiments of the invention shown in FIG. 2, 2A, and 5, it is fairly obvious what is meant by the height and the width of the water inlet. However, where the inlets are not perfectly rectangular in shape or are not oriented so that they face straight toward the bow of the vehicle, the meanings of the terms height and width are not always obvious.

To avoid confusion, the following definitions of inlet height, width and aspect ratio should be used when interpreting this specification and the attached claims. The width of an inlet is the maximum distance from one side of the inlet to the opposite side that can be measured along any line which is both perpendicular to the average direction of flow of water entering the inlet and, at every point along the line, is the same distance from that portion of the vehicle hull surface nearest to that point. The height of an inlet is the minimum distance from one side of the inlet to the opposite side along a straight line which is both perpendicular to the line along which the width dimension is measured and perpendicular to the average direction of flow of water at that point in the inlet. The aspect ratio for an individual water inlet is the width of the inlet divided by the height. The combined aspect ratio for all of the water inlets in a propulsion system is the sum of the widths of all the inlets of the system divided by the average height of all of the inlets of the system.

When the inlets are rectangular in shape, the required aspect ratio of the boundary layer inlets for a given system can be determined by the equation $$A = (W^2/Q)\, V_o(Vi/V_o) = (W^2/Q)\, V_o(IVR)$$

where $A$ is the aspect ratio of the inlet which equals the width divided by the height, $W$ is the width of the inlet, and $Q$ is the flow rate of the propulsion system, $V_o$ is the maximum velocity of the marine vehicle, and $Vi$ is the velocity of water flowing through the inlet throat. A boundary layer inlet will normally be made as wide as possible. The maximum width W of the inlet will be determined by the shape of the vehicle hull. The flow rate Q of the propulsion system will be determined by the systems power and thrust requirements. The ratio of the water inlet throat velocity Vi and the vehicle maximum speed $V_o$ is the inlet velocity ratio, IVR. This equation can be manipulated to provide a value for the required inlet height which is:

$$h = Q/(W\, V_o(IVR))$$

In practice, the maximum value allowable for the inlet velocity ratio will be limited by the possibility of cavitation occuring in the inlet at higher inlet velocities. The propulsion system must be designed so that the inlet velocities and thus the inlet velocity ratio are always small enough to avoid any significant amount of cavitation. When the inlets in a propulsion system are not rectangular in shape, the inlet height will probably need to be larger than the value calculated by the above equation.

The amount of increased efficiency that can be obtained from a boundary layer inlet depends on the extent to which the water entering the inlet comes from the boundary layers close to the hull which are moving slowly with respect to the hull. To minimize inlet drag, the inlets should be mounted in a flush or semi flush position on the hull instead of being extended away from the hull. The inlet height should be as small as possible, within the constraints discussed above, so that little or no water outside the boundary layers will enter the inlet.

The boundary layer thickness on the bottom of the hull for a marine vehicle is approximated by:

$$\delta = L^* 0.376 * (V_o L/\nu)^{-1/5}$$

where $\delta$ is the boundary layer thickness, $L$ is the wetted hull length upstream of the inlet, $V_o$ is the velocity of the vehicle with respect to the free stream water, and $\nu$ is the viscosity of water. This equation shows that the inlet should be located as close to the stern of the vehicle as possible since the boundary layer will be thickest near the stern where the value of L is largest. The equation also shows that the boundary layer becomes thinner as the vehicle velocity increases. In some types of vehicles, such as planing craft, the value of L will also decrease as the vehicle velocity increases. Therefore, the height of the inlet should, if possible, not be greater than the thickness of the boundary layer when the craft is at its maximum speed. It should also be remembered that the approximate thickness of the boundary layer decreases when the bow end of the hull surface is tilted up instead of being kept completely level.

The boundary layer water inlet systems included within the scope of this invention have aspect ratios of at least ten. There is no critical significance associated with an aspect ratio of 10 in the sense that the operation of any inlet will abruptly change as its aspect ratio is increased from a value less than 10 to a value greater than 10. Studies by the inventors have shown that the aspect ratio of the inlets for any practical water jet propulsion system must be larger than 10 if the system is to both meet the thrust requirements of the marine vehicle and at the same time draw most of its water input from the boundary layers close to the vehicle hull. The optimum value of the aspect ratio for any given vehicle will depend on the several factors discussed above. Detailed studies by the inventors of two particular marine vehicle designs, for example, resulted in the following optimum dimensions for the vehicles and their water inlets.

| | Craft A | Craft B |
|---|---|---|
| Length | 30 feet | 105 feet |
| Beam | 10 feet | 23 feet |
| $V_o$ | 30 knots | 50 knots |
| w | 6.4 feet | 16 feet |
| h | 1.5 inches | 2.9 inches |
| a | 51 | 66 |

When two or more pumps are to be used in a water jet propulsion system, this invention will make the system more efficient by minimizing the inlet distribution losses which will occur when water flows through the intake manifold to the pump intakes. The manner in which this invention minimizes these losses is by making the water flow through the intake manifold in as nearly a two dimensional flow as possible. What is meant by nearly two dimensional water flow is that at every point inside the intake manifold, the total amount of water flow is minimized in any direction which is parallel to a straight line connecting the centers of the two pump water intakes which are closest to that point. With the water flow minimized along this third dimension so defined, the flow will be nearly two dimensional along the other two dimensions. The water flow through any intake manifold can be made more nearly two dimensional by spacing all of the pump intakes approximately an equal distance apart across the width of the manifold, by increasing the number of pump intakes, and by adjusting the shape of the manifold, as shown in FIG. 1, so that water entering each point of the inlet is channeled to that pump intake nearest to that point of the inlet.

Obviously many modifications and variations of this invention are possible in light of the above teachings. It is therefore to be understood that within the scope of the following claims the invention may be practiced otherwise than as specifically described.

What is claimed is:

1. A water jet propulsion system for a marine vehicle comprising:

at least one water pump, each pump being positioned near the stern of the vehicle and having a water output and at least one water intake;

at least one power source connected to and used for driving each water pump;

a nozzle connected to the output of each pump;

at least one water inlet, with the aspect ratio of each water inlet being larger than 10, each inlet being located on the rear portion of the vehicle hull, each inlet facing toward the bow end of the vehicle, the positions of each inlet adjusted so that only one inlet will intersect any straight line extending parallel to the bow-stern axis of the vehicle, and with the height of each inlet adjusted so that when said vehicle is moving at its maximum speed, most of the water entering each inlet will come from the boundary layer close to the vehicle hull;

at least one pump intake manifold which directs water entering said water inlets to the intakes of each pump, with the pumps and the inlets positioned relative to each other so that water flowing through the intake manifolds will continuously move toward the stern of the boat as it flows toward the pump intakes.

2. The water jet propulsion system of claim 1 wherein the number of water inlets is limited to one, the one water inlet is located along the bottom of the marine vehicle hull and the width dimension of the inlet extends most of the distance from one side of the bottom of the hull to the other side.

3. The water jet propulsion system of claim 2 wherein:

the number of said pumps is at least two;

the number of said power sources for driving said pumps is two; and the propulsion system further comprises two clutches and a drive shaft for transmitting rotational power from said two power sources to all of said pumps,. with one of said clutches placed at each of the two ends of said drive shaft between the drive shaft and one of the two power sources so that either of the two power sources may be disconnected from the drive shaft by means of one of the clutches while the other power source continues to supply rotational power to the drive shaft and the pumps.

4. The water jet propulsion system of claim 3 wherein the number of said pump intake manifolds is limited to one, said manifold is shaped so that the water entering through each point of said water inlet is channeled to one of said pump intakes nearest to that point with water entering through different but adjacent areas of the water inlet being channeled to different but adjacent pump intakes, with the location and spacing of the pump intakes being adjusted so as to cause the water flow through the intake manifold to be substantially two dimensional.

5. The water jet propulsion system of claim 1 wherein the number of pumps is at least two, said pump intakes connected to said water inlets by means of said pump intake manifolds, each of said pump intake manifolds being connected to at least two pump intakes, the shape of the pump intake manifolds being arranged so that the water entering through each point of each water inlet is channeled to one of the pump intakes which is nearest to that point, with water entering through different but adjacent areas of each water inlet being channeled to different but adjacent pump intakes, with the location and spacing of said pump intakes being adjusted so as to cause the water flow through the intake manifold to be substantially two dimensional.

6. The water jet propulsion system of claim 1 further comprising:

at least one drive shaft for transmitting rotational power from said power sources to said pumps, with one of said drive shafts transmitting power between at least two of the power sources and at least two of the pumps;

a plurality of clutches placed in said drive shafts between said separate power sources and said pumps so that power sources can be either connected or disconnected from the pumps, said clutches being arranged so that where one of said drive shafts is transmitting power between at least two of said power sources and at least two of said pumps each of the power sources can be disconnected from the drive shaft by means of clutches with the power sources which remain connected to drive shaft continuing to provide rotational power to the drive shaft; and wherein the number of said power sources is at least two and the number of said pumps is at least two, said pump intakes connected to said water inlets by means of said pump intake manifolds, each of said pump intake manifolds being connected to at least two pump intakes, the shape of said pump intake manifolds being arranged so that the water entering through each point of each water inlet is channeled to one of the pump intakes which is nearest to that point, with water entering through different but adjacent areas of each water inlet being channeled to different but adjacent pump intakes, with the location and spacing of said pump intakes being adjusted so as to cause the water flow through the intake manifold to be substantially two dimensional.

7. The water jet propulsion system of claim 1 further comprising:

at least one drive shaft for transmitting rotational power from said power sources to said pumps, with one of said drive shafts transmitting power between at least two of the power sources and at least two of the pumps;

a plurality of clutches placed in said drive shafts between said power sources and said pumps so that the power sources can be either connected or disconnected from the pumps, said clutches being arranged so that where one of said drive shafts is transmitting power between at least two of said power sources and at least two of said pumps each of the power sources can be disconnected from the drive shaft by means of the clutches with the power sources which remain connected to the drive shaft continuing to provide rotational power to the drive shaft; and wherein the number of pumps is at least two and the number of power sources is at least two.

8. The water jet propulsion system of claim 1 wherein the number of water inlets is at least two.

9. The water jet propulsion system of claim 1 wherein the average height dimension of said inlets is less than five inches and the combined aspect ratio of all of said inlets is larger than forty.

10. The water jet propulsion system of claim 1 wherein the type of marine vehicle on which the system is used is limited to planing vehicles.

11. The water jet propulsion system of claim 1 wherein the cross sectional area of the intake manifold as measured on a cross section which is approximately perpendicular to the direction of water flow, is small enough so that it is not substantially larger than the combined cross sectional area of all the pump intakes connected to the intake manifold.

* * * * *